US007624457B2

(12) United States Patent
Sedlmair et al.

(10) Patent No.: US 7,624,457 B2
(45) Date of Patent: Dec. 1, 2009

(54) HEAD GEAR

(76) Inventors: Paul Sedlmair, Kirchenweg 5, D-86668, Burgheim (DE); Josef Sedlmair, Ptaetzerstr. 8, D-86684, Holzheim (DE)

( * ) Notice: Subject to any disclaimer, the term of this patent is extended or adjusted under 35 U.S.C. 154(b) by 0 days.

(21) Appl. No.: 11/501,953

(22) Filed: Aug. 10, 2006

(65) Prior Publication Data

US 2007/0136929 A1 Jun. 21, 2007

(30) Foreign Application Priority Data

Aug. 10, 2005 (DE) ..... 20 2005 012 630 U

(51) Int. Cl.
*A42B 1/24* (2006.01)

(52) U.S. Cl. ..... 2/171; 2/209.13; 2/410; 2/425

(58) Field of Classification Search ..... 2/209.13, 2/171, 446, 425; 446/27
See application file for complete search history.

(56) References Cited

U.S. PATENT DOCUMENTS

| | | | | |
|---|---|---|---|---|
| 696,814 | A * | 4/1902 | Hatch | 446/206 |
| 2,593,188 | A * | 4/1952 | Rikelman | 446/27 |
| 5,504,943 | A * | 4/1996 | Han | 2/209.13 |
| 6,457,183 | B1 * | 10/2002 | Perry, Sr. | 2/209.12 |
| 7,159,248 | B1 * | 1/2007 | Saintlot | 2/206 |
| 7,284,284 | B2 * | 10/2007 | Wysopal | 2/209.13 |
| 2004/0117894 | A1 * | 6/2004 | Kuo | 2/209.13 |
| 2004/0244096 | A1 * | 12/2004 | Claro | 2/195.2 |
| 2007/0271679 | A1 * | 11/2007 | Wysopal | 2/209.13 |

* cited by examiner

*Primary Examiner*—Gary L Welch
*Assistant Examiner*—Alissa J Tompkins
(74) *Attorney, Agent, or Firm*—Robert L. Epstein; Epstein Drangel Bazerman & James, LLP

(57) ABSTRACT

The invention relates to a head gear. The object of the invention is to increase the functionality of the head gear concerning playing and security features. To achieve said object the head gear comprises a whistle attached to it.

4 Claims, 1 Drawing Sheet

HEAD GEAR

FIELD OF THE INVENTION

The invention relates to a head gear.

SUMMARY OF THE INVENTION

The object of the invention is to increase the functionality of a head gear concerning playing and security features.

The head gear according to the invention contains a whistle attached to it. This whistle can be used just for fun. Additionally the whistle can be used in emergency situations to inform safety persons.

To avoid losing of the whistle it is advantages to attach said whistle to said head gear by sticking, sewing, clipping, slipping on or by means of a Velcro. It is possible to use one of the above identified attaching methods only but also combining two more of said methods together.

The invention may be used for different head gears, like hats, storm volumes and protective helmets. Nevertheless it is preferable to use the invention for caps. The reason for this is, that it is more easy to attach a whistle to a cap than to any other head gear.

Another object of the invention is to attach the whistle to the head gear in a way, that it is easy to blow into said whistle. To achieve this object, the cap contains a cap screen with a free end. The whistle contains a mouth peace being directed to said free end of the cap screen. Therefore the mouthpiece can be easily fit into the mouth by turning the cap screen. If the cap screen is large enough, it is not necessary, to take off the cap. On the other hand, if the cap screen is not long enough, to achieve this feature, it is usually sufficient to shift the cap forward.

DETAILED DESCRIPTION OF THE INVENTION

Figure 1:
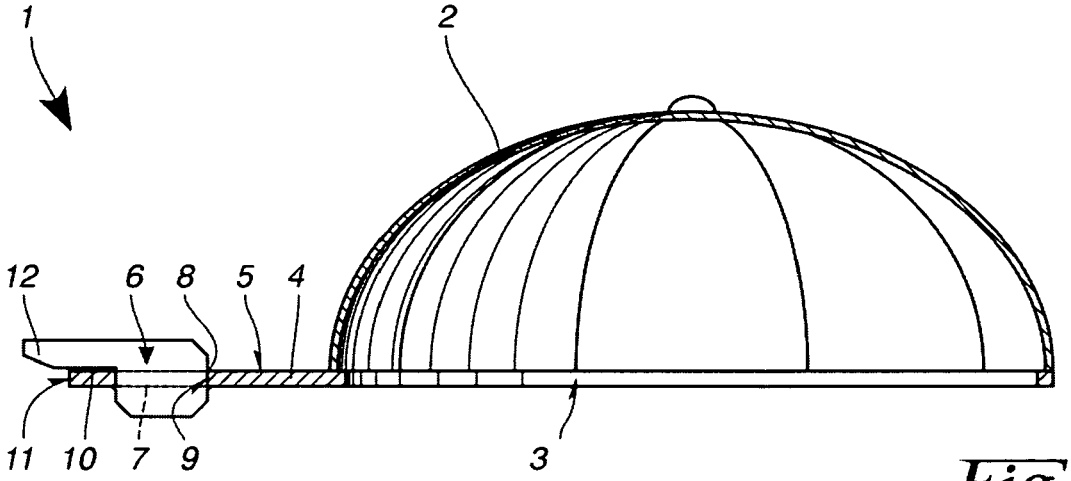
FIG. 1 shows a cross sectional view of a cap according to the invention.
Figure 2:
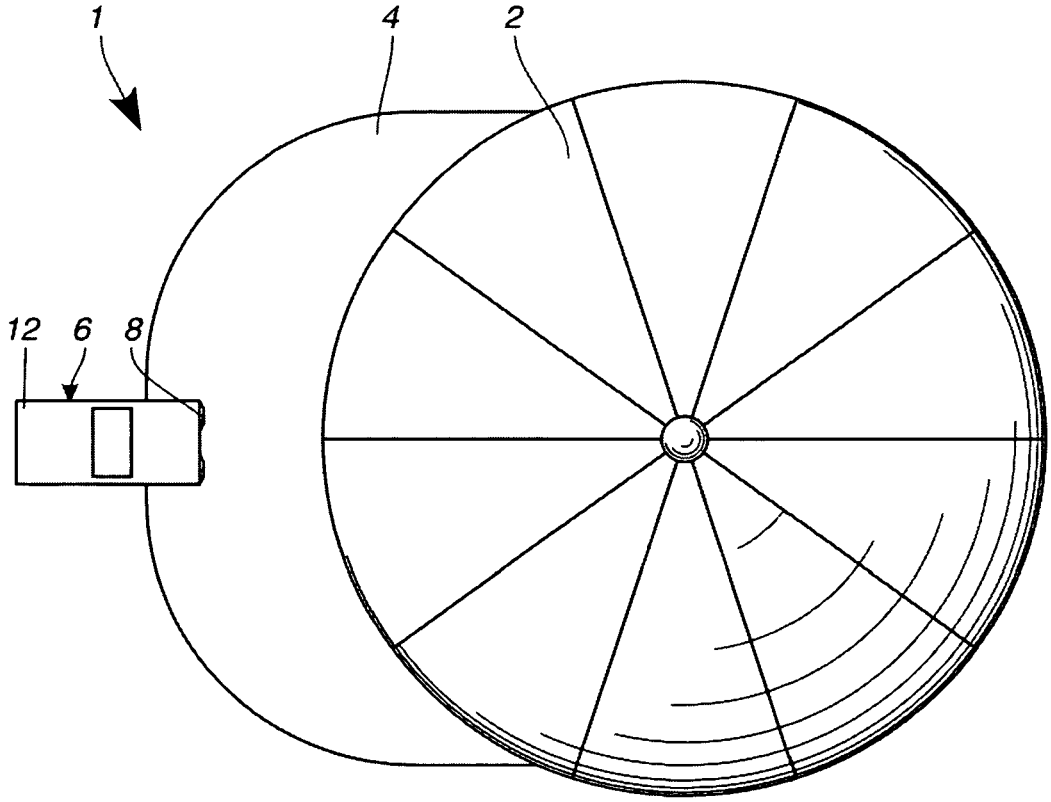
FIG. 2 shows a top view of the cap according to FIG. 1.

Further advantages and features of the present invention will be presented in the following detailed description using the associated figures, which contain a plurality of exemplary embodiments of the present invention. However, it should be understood that the drawing serves merely for the purpose of illustrating the invention and not restricting the scope of protection of the invention.

A cap 1 comprises a body 2 formed to partially cover a non shown had of a person. The body 2 is made from a textile material. Alternatively the body 2 can be made from a polymer or a mixture of both materials. The body 2 has an open end 3, fitting to the non shown had.

The cap 1 additionally comprises a cap screen 4, which is attached to the body 2 at its open end 3. The cap screen 4 partially surrounds the body 2. The cap screen 4 is made from a harder material than the body 2 to be form resistant. The cap screen 4 can also be made from the same material as the body 2, but being straightened by means of a reinforcement layer made from a force resistant material.

The cap screen 4 has a top surface 5, to which a whistle 6 is attached to. To produce a flat configuration of the cap screen 4, it contains a hole 7, penetrated by a part of the whistle 6. Therefore the whistle 6 is positioned partially enough, partially below and partially within the layer of the cap screen 4.

To achieve a good fit of the whistle 6 to the cap screen 4, the whistle 6 contains a snap joint 8, which engages the cap screen 4 within the hole 7. Additionally the surface 9 engaging the cap screen 4 may contain a glue, to achieve a better joint of the whistle 6 to the cap screen 4.

Alternatively or additionally the cap screen 4 comprises a Velcro 10—a hook and loop fastener—to achieve a better joint between the whistle 6 and the cap screen 4. The Velcro 10 is preferably sewed to the cap screen 4.

The cap screen 4 has a free end 11. The whistle 6 comprises a mouthpiece 12, which is directed to the free end 12 of the cap screen 4. This allows the usage of the whistle 6 with the cap 1 on the head.

Since some exemplary embodiments of the present invention have not been shown or described, it must be understood that a large number of changes and modifications of these exemplary embodiments described are possible without departing from the substantial idea and the scope of protection of the invention which is defined by the claims.

LIST OF REFERENCE NUMERALS

1 cap
2 body
3 open end
4 cap screen
5 top surface
6 whistle
7 hole
8 snap joint
9 surface
10 Velcro
11 free end
12 mouthpiece

What is claimed is:

1. A head gear with a cap screen having a free end, and a whistle, said whistle comprising a body with an upper portion and a lower portion and a mouthpiece extending outwardly from said upper portion of said body, said mouthpiece having a bottom surface, said cap screen comprising a hole situated at a location spaced from said free end of said cap screen by a distance less that the length of said mouthpiece adapted to receive said lower portion of said whistle therein with at least a portion of said bottom surface of said mouthpiece supported by said cap screen and at least a portion of said mouthpiece extending beyond said free end of said cap screen.

2. The head gear of claim 1 wherein said whistle is attached to said head gear by at least one of sticking, sewing, slipping on or by means of hook and loop fastener.

3. A head gear according to claim 1, wherein said head gear is a cap.

4. The head gear of claim 1 wherein said hole in said cap screen is at least partially defined by an edge and wherein said snap joint engages said edge.

* * * * *